US007896605B2

(12) United States Patent
Davis

(10) Patent No.: US 7,896,605 B2
(45) Date of Patent: Mar. 1, 2011

(54) APPARATUS FOR REMOVING WASTE FROM A STORAGE CONTAINER

(76) Inventor: Rufus Davis, Robeline, LA (US)

( * ) Notice: Subject to any disclaimer, the term of this patent is extended or adjusted under 35 U.S.C. 154(b) by 369 days.

(21) Appl. No.: 12/119,093

(22) Filed: May 12, 2008

(65) Prior Publication Data

US 2008/0276406 A1 Nov. 13, 2008

Related U.S. Application Data

(60) Provisional application No. 60/917,374, filed on May 11, 2007.

(51) Int. Cl.
*B60P 1/00* (2006.01)
*B60F 1/00* (2006.01)
*B60F 3/00* (2006.01)

(52) U.S. Cl. ..... 414/516; 414/509; 414/510; 414/511; 414/512; 414/513; 414/514; 414/515; 414/517; 15/347; 15/340.1

(58) Field of Classification Search ..... 15/347, 15/340.1; 414/509–517
See application file for complete search history.

(56) References Cited

U.S. PATENT DOCUMENTS 3,252,602 A * 5/1966 Bowles ..... 414/511
3,273,728 A * 9/1966 Kelso ..... 414/513
4,134,174 A 1/1979 Flynn et al.
4,221,527 A * 9/1980 Morrison ..... 414/517
4,260,316 A 4/1981 Gollnick
4,627,783 A * 12/1986 De Filippi ..... 414/517
5,049,026 A 9/1991 Bingman et al.
5,314,290 A * 5/1994 Lutz et al. ..... 414/509
2005/0254930 A1 11/2005 Weinstein et al.

OTHER PUBLICATIONS

International Search Report issued Sep. 29, 2008, during the prosecution of International Application No. PCT/US2008/063356. Published Nov. 20, 2008.
Written Opinion issued 29, 2008, during the prosecution of International Application No. PCT/US2008/063356.
International Preliminary Report on Patentability, issued Nov. 17, 2009 (published Nov. 17, 2009) during the prosecution of International Application No. PCT/US2008/063356.

* cited by examiner

*Primary Examiner*—Bryan R Muller
(74) *Attorney, Agent, or Firm*—Fulbright & Jaworski LLP

(57) ABSTRACT

An extension plate assembly for dumping debris into a dump box from a storage tank mounted on a trunk. The storage tank is fitted with a pusher plate that both compacts and pushes debris out of the back of the storage tank. The extension plate apparatus includes extension arms that are rotatably attached on one end to the pusher plate and rotatably attached on the other end to an extension plate. When the pusher plate is in its rearward most position, the extension arms extend beyond the edge of the storage tank. The extension plate assembly allows debris to be pushed out of the storage tank and distributed more evenly into a dump box.

11 Claims, 3 Drawing Sheets

APPARATUS FOR REMOVING WASTE FROM A STORAGE CONTAINER

CROSS-REFERENCE TO RELATED APPLICATIONS

This application claims priority to U.S. Provisional Application Ser. No. 60/917,374, filed on May 11, 2007, which is hereby incorporated by reference in its entirety.

TECHNICAL FIELD

This invention relates to a method and device for unloading debris from a vehicle-mounted storage tank into a dump box, and more particularly, the invention relates to an extension plate that moves axially within the storage tank to assist in the unloading process.

BACKGROUND OF THE INVENTION

Sewage cleaning vehicles are specially designed vehicles for cleaning sewers, storm drains, and catch basins and for transporting collected debris to a dumpsite. A storage tank mounted on the vehicle holds the collected debris until it is transported to a dumpsite. At the dumpsite, the vehicle operator typically dumps the debris into a dump box. Crew members manually assist in removing debris from the storage tank.

The problem with known devices and methods for removing debris from the vehicle's storage tank is that debris piles up in the dump box in front of the storage tank. As a result, the debris pile must be spread more evenly in the dump box and away from the storage tank. Crew members spread the debris by hand, using shovels or the like.

BRIEF SUMMARY OF THE INVENTION

The present invention provides a new apparatus and method that overcomes the above and other shortcomings of the known art. The inventive apparatus and method allow an operator to more evenly distribute debris in a dump box without the need for crew members to manually spread the debris.

One embodiment of the present invention is directed to a debris storage tank emptying system that includes a storage tank with an inner floor and an opening therein for emptying debris; a pusher plate movable within said storage tank between a retracted position and an extended position, wherein the extended position is close to the opening of said storage tank; an extension arm positioned within said storage tank between said pusher plate and the opening of said storage tank and configured to move with said pusher plate; wherein said extension arm extends beyond the opening in said storage tank when said pusher plate is in the extended position; and an extension plate attached to said extension arm. The extension arm may be pivotally attached to said pusher plate. The extension arm may also be 4 feet long and/or it may be sized to support said extension plate inside said storage tank when said pusher plate is fully retracted.

The extension arm of the debris storage tank emptying system may be generally parallel to the inner floor of said storage tank when said extension plate is within said storage tank and said extension arm may be configured to angled downward when said extension plate is outside of said storage tank. Additionally, the extension plate may be pivotally attached to said extension arm so that it is generally perpendicular to said extension arm when said pusher plate is being moved toward the opening in said storage tank. The extension plate may be pivotally attached to said extension arm to reduce resistance from debris when said pusher plate is moved toward the retracted position.

Another embodiment is directed to an extension plate assembly that includes an extension arm configured to be pivotally mounted to a pusher plate and an extension plate; wherein said extension plate is configured to push debris. The extension plate assembly may further include a support arm extending from said extension arm and engaging said extension plate when said extension plate is pushing debris. The support arm may maintain said extension plate generally perpendicular to said extension arm when said extension arm is pushed by a pusher plate. The support arm may be unitary with said extension arm. The extension plate assembly may further comprise an auxiliary support arm extending from said extension arm, wherein said auxiliary support arm is configured to follow a path inside a storage tank. Additionally or alternatively, the auxiliary support arm may limit the clockwise angular rotation of said extension arm. The extension arm may have a cross section that maintains said extension plate in a generally perpendicular position with respect to said extension arm when said extension arm is pushed by a pusher plate. The extension arm may be sized to extend the length of a storage tank. The assembly may also include more then one extension arm. For example, two extension arms may be used.

Another embodiment is directed to a sewer cleaning vehicle comprising, a truck; a debris collection tank with an opening therein for dumping debris, wherein said debris collection tank is positioned on said truck; a pusher plate positioned inside said debris collection tank and capable of being retracted and extended, wherein said pusher plate is configured to push debris out the opening in said debris collection tank when extended; an extension plate positioned between said pusher plate and the opening in said debris collection tank and adapted to extend out of the opening in said debris collection tank when said pusher plate is extended. The sewer cleaning vehicle may also include an extension arm pivotally connected to said extension plate and positioned between said pusher plate and said extension plate. The extension arm may be pivotally attached to said pusher plate. The extension plate may be configured to push debris away from said debris collection tank but not pull debris toward said debris collection tank. The length of said extension arm is equal to or less than the distance said pusher plate travels between its most retracted position and its most extended position. The sewer clearing vehicle may also include positionable debris guides.

The foregoing has outlined rather broadly the features and technical advantages of the present invention in order that the detailed description of the invention that follows may be better understood. Additional features and advantages of the invention will be described hereinafter which in addition to the above form the subject of the claims of the invention. It should be appreciated that the conception and specific embodiments disclosed may be readily utilized as a basis for modifying or designing other structures for carrying out the same purposes of the present invention. It should also be realized that such equivalent constructions do not depart from the invention as set forth in the appended claims. The novel features which are believed to be characteristic of the invention together with further objects and advantages will be better understood from the following description when considered in connection with the accompanying figures. It is to be expressly understood, however, that each of the figures are provided for the purpose of illustration and description only and are not intended to define of the limits of the present invention.

DETAILED DESCRIPTION OF THE INVENTION

Figure 1:
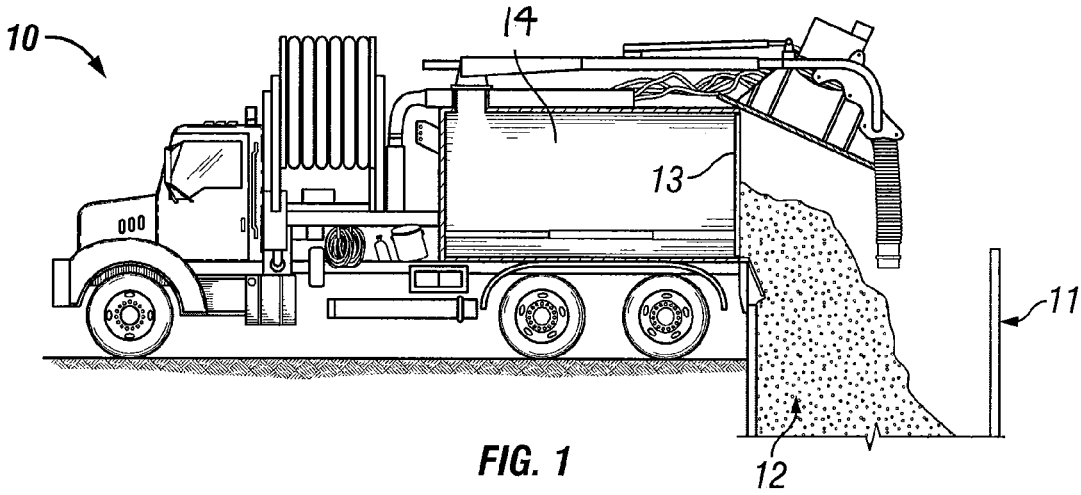
FIG. 1 is a side view of a sewage cleaning vehicle dumping debris from its storage tank into a dump box.

FIG. 1 shows sewage utility cleaning vehicle (10). The vehicle includes pusher plate (13) that can be moved forward and backward within storage tank (14). The pusher plate (13), which is shaped to fit within storage tank (14), compacts debris (12) that is collected from various cleaning operations and pushes (dumps) it into dump box (11). Upon ejection, debris (12) piles up at the edge of dump box (11). Before vehicle (10) can pull away, debris (12) has to be distributed more evenly in dump box (11). The crew distributes debris (12) in the dump box using shovels or the like.

Figure 2:
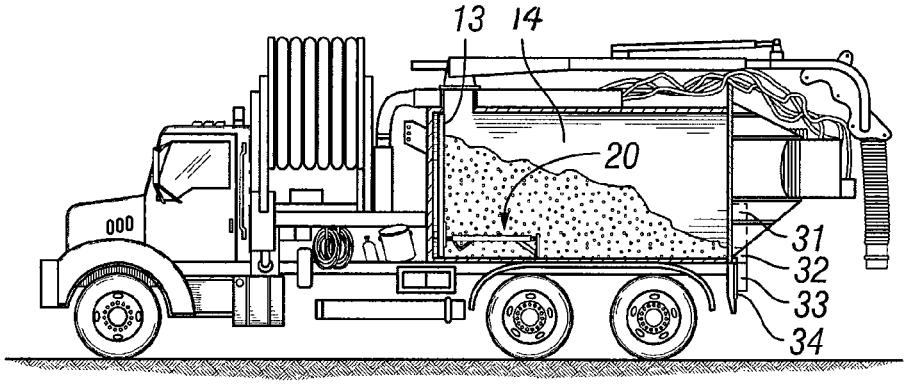
FIG. 2 is a side view of a sewage cleaning vehicle including an embodiment of the novel extension plate assembly installed shown in a retracted position within the storage tank.

FIG. 2 shows a sewage utility cleaning vehicle equipped with an embodiment of the novel extension plate assembly (20). The extension plate assembly (20) is mounted on pusher plate (13) and moves with pusher plate (13) axially within the storage tank (13). Extension plate (22) may ride on wear pads (not shown) as it slides backwards and forwards in storage tank (14).

Figure 3:
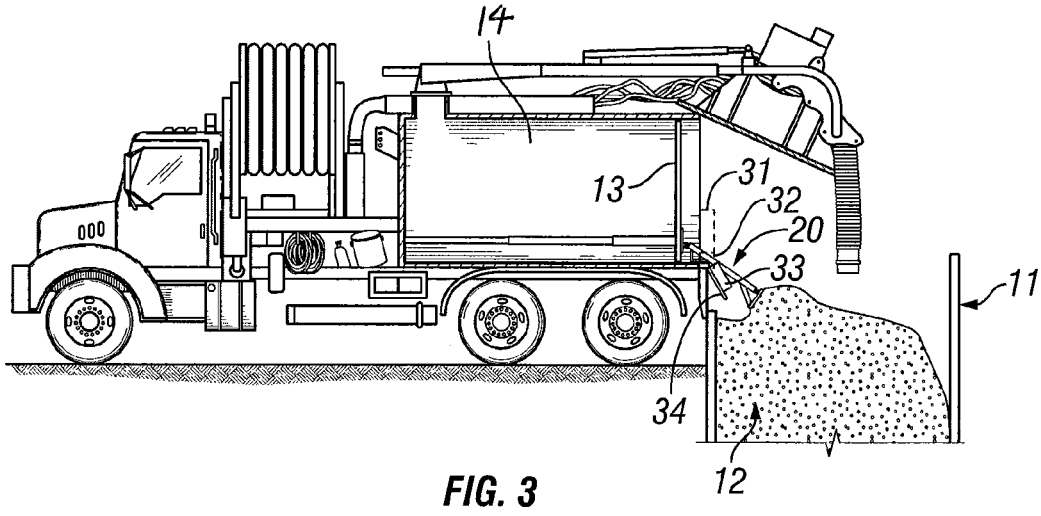
FIG. 3 is a side view of a sewage cleaning vehicle including an embodiment of the novel extension plate assembly shown in an extended position.

FIG. 3 shows extension plate assembly (20) in an extended position. The extension plate assembly has extension arms (21) that are attached to pusher plate (13) at hinges (23) (See FIG. 4A). Thus, as the extension plate (22) clears the rear edge of the storage tank (14), the extension plate assembly (20) rotates about hinges (23) and extension plate (22) drops downward into dumb box (11). Continued rearward motion of pusher plate (13) pushes extension plate assembly (20) downward and into dump box (11), moving debris (12) away from the edge of dump box (11). When fully extended, extension plate assembly (20) protrudes from storage tank (14) into dump box (11).

The dumping system may include debris guiding structures that can be attached to the vehicle on the outer rim of the storage tank near the open end. The guiding structures direct the debris into the dump box and prevent spillage out of the sides of the storage tank during the dumping process. The debris guide structures including upper right and left side guides (31) (shown with a dashed line), lower right and left side guides (32), right and left lower guide plates (33), and a water shed (34). In a preferred embodiment, the upper right and left side guides are welded to the outer rim of storage tank (14), but other rotatable attachments are envisioned. The lower right and left side guides, lower guide plate, and water shed are preferably rotatably attached to the rim of the tank. During the dumping process, the rotatable guides are adjusted from a vertical hanging position to a substantially horizontal engaged position for better directing the debris outward away from the tank and into dump box (11).

Figure 4A:
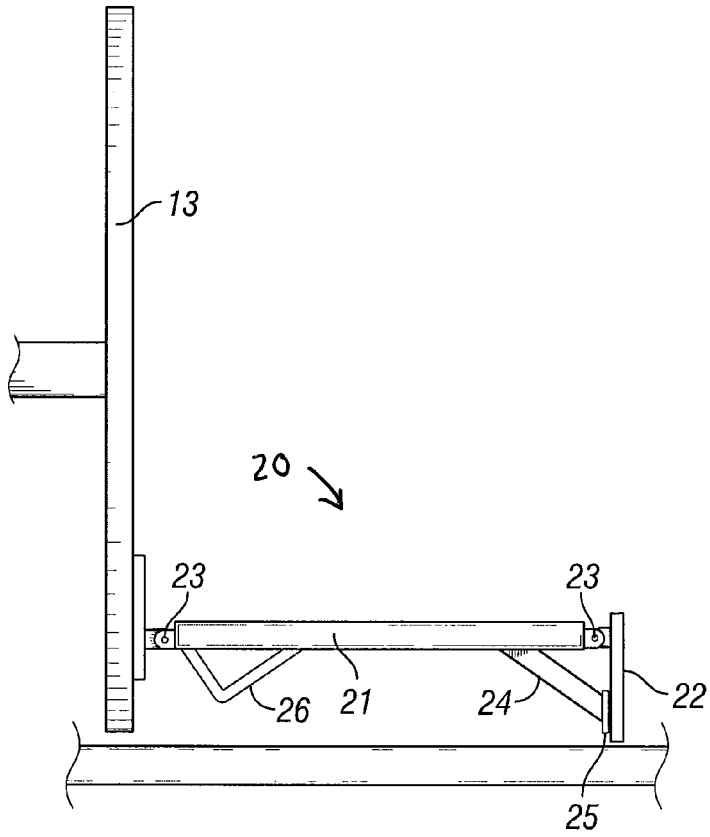
FIG. 4A is a side view of an embodiment of the novel extension plate assembly shown in a retracted position.
Figure 4B:
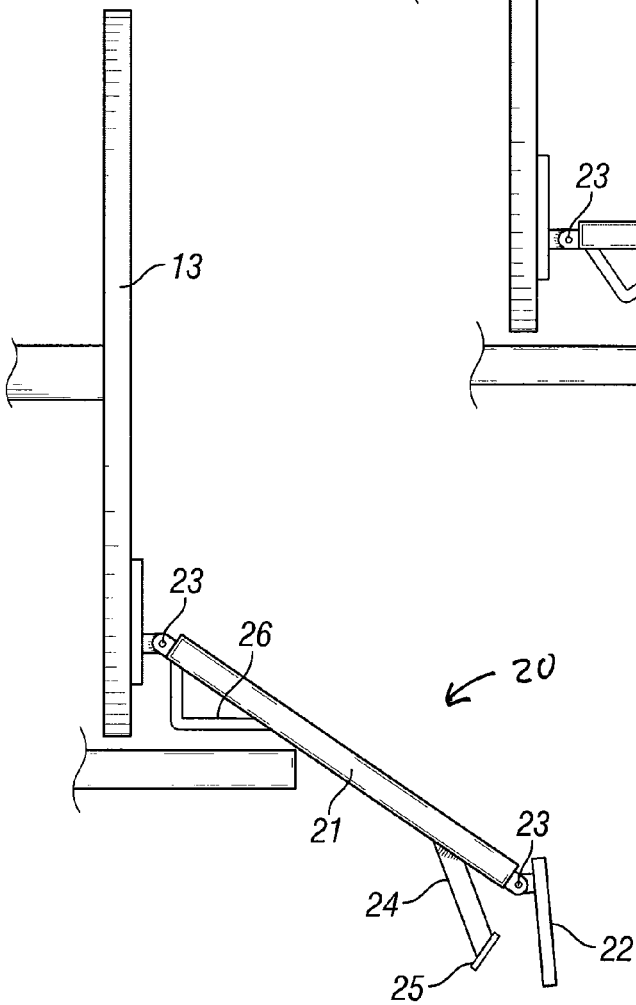
FIG. 4B is a side view of an embodiment of the extension plate assembly rotated by gravity in an extended position.
Figure 5:
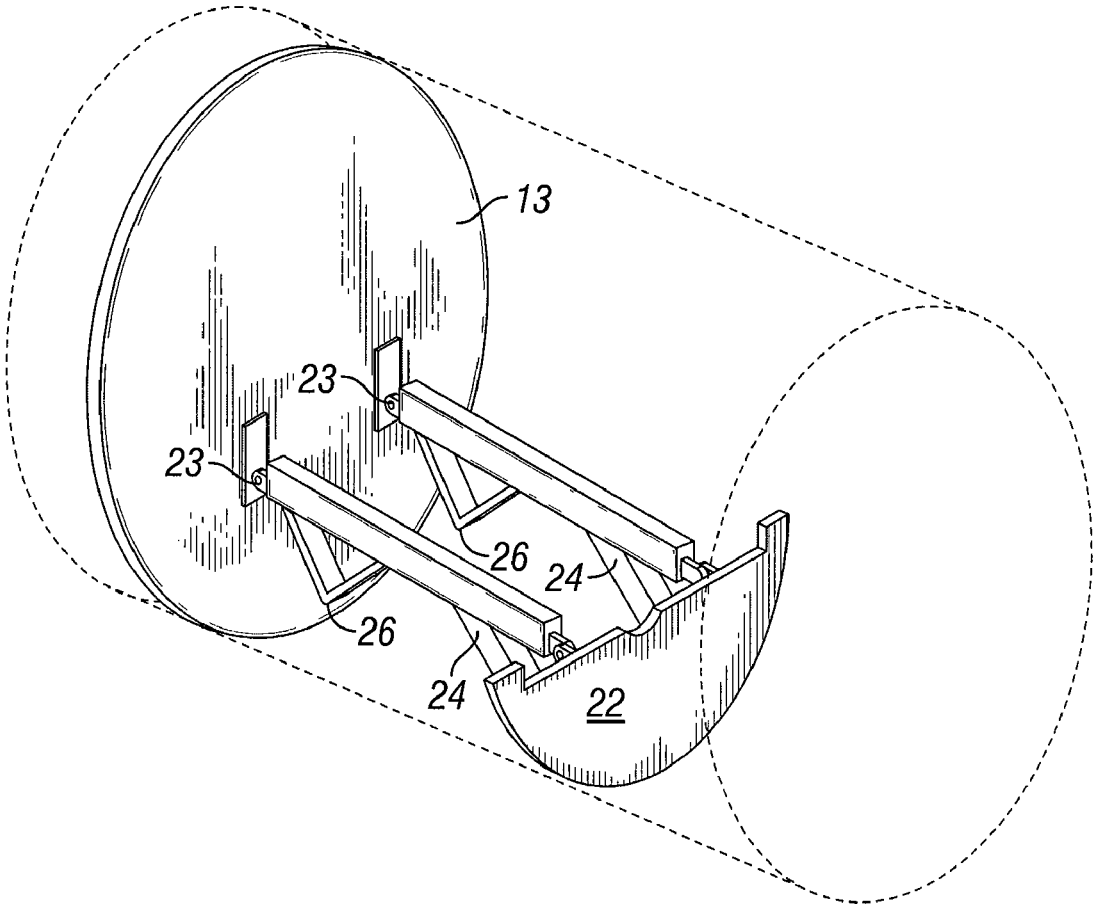
FIG. 5 is a perspective view of an embodiment the novel extension plate assembly.

FIGS. 4A and 4B show an embodiment of extension plate assembly (20). Extension plate assembly (20) includes extension arms (21), which in one embodiment are rectangular, that transmit the axial force from pusher plate (13) to extension plate (22) during use. Although two extension arms (21) are shown, any number may be used. Extension arms (21) are sized to push debris into dump box (11). FIG. 2 shows extension arms (21) as being relatively short compared to the length of storage tank (14). However, one skilled in the art readily understand the arms can be made much longer. For example, the arms can be made so that the extension plate (22) is just inside the opening of storage tank (14) when pusher plate (13) is in its most retracted (forward) position.

Extension plate (22) is preferably shaped to match storage tank (14) and has a surface area less than that of pusher plate (13). Extension plate (22) is shown as being solid, but one skilled in the art readily understands that it may be mesh, wire, or combinations thereof. Extension plate (22) is rotatably coupled to the extension arms (21) by hinges (23), allowing extension plate (22) to rotate from a vertical to a more horizontal position during use. Support arms (24) extend from extension arms (21) to provide axial support against extension plate (22) as it pushes debris out of the tank and into dump box (11). Although support arms (24) are shown as arms, one skilled in the art readily understands "support arms" as used herein can be any shape. For example, the support arms can be a triangular or rectangular. Further, the support arms can be the lower portion of extension arms (21). Still further, support arms can be part of extension plate (22). Support arms (24) keep extension plate (22) in a generally vertical position as the assembly moves backward (toward the opening) in storage tank (14). As extension plate assembly (20) is retracted (moves forward in the tank toward the front of truck (10)), the extension plate is free to pivot (rotate) counter-clockwise to a more horizontal position to pass over debris that may exist between the pusher plate and extension plate. Although some debris may be pulled toward the truck when the pusher plate is being retracted, extension plate (22) should pivot easy enough to ride on top of most of the debris while being retracted.

One embodiment includes auxiliary support arms (26) shaped to guide the path of extension plate (22) as extension plate assembly (20) is moved backward and out of storage tank (14). For example, support arms (26) may engage a wedge on the bottom of storage tank (14) (not shown). As support arms (26) move up and over the wedge, extension plate (22) is lifted off of the bottom of storage tank (14). Another example of how support arms (26) can be shaped to guide extension plate (22) is by limiting how low into dump box (11) extension plate (22) can extend. In limiting the lower extension, support arms (26) essentially create an optimal pushing angle between pusher plate (13) and the debris pile after the extension plate has cleared the back of storage tank (14). Support arm (26) is preferably shaped to allow extension arm (21) to hang at a specific angle relative to pusher plate (13) when the assembly is fully extended.

In one embodiment, material in the holding tank of a sewage utility cleaning vehicle is dumped as follows: The vehicle is backed to the edge of dump box (11). The debris guides and plates are locked into their dump positions. The tank lid is opened and the dumping of debris begins. Optimally, truck (10) includes a control switch positioned within sight of the dump box (11) and storage tank (14). The control switch can be used to control movement of pusher plate (13). To dump debris, pusher plate (13) is moved toward the back of truck (10). As debris is dumped into dump box (11), extension plate assembly (20) helps spread the debris pile in dump box (11). The pusher plate (13) is then retracted (moved toward the front of truck (10)). The process may be repeated multiple time to fully spread the debris pile in dump box (11). After the debris has been dumped, the lid is closed, the debris guides are restored to their transport position, and the vehicle is readied for movement.

Although the present invention and its advantages have been described in detail, it should be understood that various changes, substitutions and alterations can be made herein without departing from the invention as defined by the appended claims. Moreover, the scope of the present application is not intended to be limited to the particular embodiments of the vehicles and the methods described in the specification. Accordingly, the appended claims are intended to include within their scope such articles and methods.

What is claimed is:

1. A debris storage tank emptying system comprising, a storage tank with an inner floor and an opening therein for emptying debris;

a pusher plate movable within said storage tank between a retracted position and an extended position, wherein the extended position is close to the opening of said storage tank;

an extension arm pivotally attached to said pusher plate and positioned within said storage tank between said pusher plate and the opening of said storage tank and configured to move with said pusher plate; wherein said extension arm extends beyond the opening in said storage tank when said pusher plate is in the extended position, and wherein said extension arm is generally parallel to the inner floor of said storage tank when said extension plate is within said storage tank and said extension arm is angled downward when said extension arm plate is outside of said storage tank; and an extension plate pivotally attached to said extension arm.

2. The debris storage tank emptying system of claim 1, wherein said extension arm is approximately 4 feet long.

3. The debris storage tank emptying system of claim 1, wherein said extension arm is sized to support said extension plate inside said storage tank when said pusher plate is fully retracted.

4. The debris storage tank emptying system of claim 1, wherein said extension plate is pivotally attached to said extension arm and is generally perpendicular to said extension arm when said pusher plate is being moved toward the opening in said storage tank.

5. The debris storage tank emptying system of claim 1, wherein said extension plate is pivotally attached to said extension arm to reduce resistance from debris when said pusher plate is moved toward the retracted position.

6. The debris storage tank emptying system of claim 1, wherein said extension plate is pivotally attached to said extension arm such that said extension plate can push debris but not pull debris.

7. The sewer cleaning vehicle comprising, a truck;

a debris collection tank with an opening therein for dumping debris, wherein said debris collection tank is positioned on said truck;

a pusher plate positioned inside said debris collection tank and capable of being retracted and extended, wherein said pusher plate is configured to push debris out the opening in said debris collection tank when extended;

an extension plate positioned between said pusher plate and the opening in said debris collection tank and adapted to extend out of the opening in said debris collection tank when said pusher plate is extended and, an extension arm pivotally connected to said pusher plate and said extension plate, wherein said extension arm is generally parallel to the floor of said debris collection tank when said extension plate is within said debris collection tank and said extension arm is angled downward when said extension plate is outside of debris collection tank.

8. The sewer cleaning vehicle of claim 7 wherein said extension arm is positioned between said pusher plate and said extension plate.

9. The sewer cleaning vehicle of claim 8 wherein said extension plate is configured to push debris away from said debris collection tank but not pull debris toward said debris collection tank.

10. The sewer cleaning vehicle of claim 8, wherein the length of said extension arm is equal to or less than the distance said pusher plate travels between its most retracted position and its most extended position.

11. The sewer clearing vehicle of claim 10, further comprising positionable debris guides.

* * * * *